United States Patent [19]

Haffer et al.

[11] Patent Number: 4,503,935

[45] Date of Patent: Mar. 12, 1985

[54] LIFT JACK RETENTION BRACKET

[75] Inventors: John J. Haffer, Euclid; Alan T. Fredrick, Mentor, both of Ohio

[73] Assignee: Towmotor Corporation, Mentor, Ohio

[21] Appl. No.: 357,945

[22] Filed: Mar. 15, 1982

[51] Int. Cl.[3] ..... B66B 9/20

[52] U.S. Cl. ..... 187/9 E; 187/1 R; 248/635

[58] Field of Search ..... 187/9 E, 9 R, 1 R; 248/632, 634, 635

[56] References Cited

U.S. PATENT DOCUMENTS

| | | | |
|---|---|---|---|
| 1,824,732 | 9/1931 | Paton | 248/634 |
| 2,747,689 | 5/1956 | Abbe | 187/9 E |
| 2,936,045 | 5/1960 | Quayle | 187/9 E |
| 3,289,791 | 12/1966 | Ulinski | 187/9 |
| 3,330,383 | 7/1967 | Pusztay | 187/9 E |
| 3,608,761 | 9/1971 | Taylor | 187/9 E X |
| 3,741,346 | 6/1973 | Herdemann | 187/9 E |
| 3,830,342 | 8/1974 | Allen | 187/9 E |
| 3,972,388 | 8/1976 | McVeen | 187/9 E |
| 4,030,568 | 6/1977 | Heinold | 187/9 E |
| 4,082,199 | 4/1978 | Friesen et al. | 187/9 R X |
| 4,221,530 | 9/1980 | Williams et al. | 187/9 R X |
| 4,234,057 | 11/1980 | Nakane et al. | 187/9 E |

FOREIGN PATENT DOCUMENTS

| | | | |
|---|---|---|---|
| 1800002 | 10/1978 | Fed. Rep. of Germany | 187/9 E |

*Primary Examiner*—Joseph J. Rolla
*Assistant Examiner*—Lawrence J. Miller
*Attorney, Agent, or Firm*—Phillips, Moore, Lempio & Finley

[57] ABSTRACT

A lift mast for industrial trucks includes a stationary upright having a movable upright mounted thereon and a lift jack interconnected between the uprights. A bracket member is secured to a cylinder of the lift jack and is further secured to the stationary upright along with at least one elastomeric bushing that will allow the cylinder to move slightly relative to the stationary upright.

4 Claims, 6 Drawing Figures

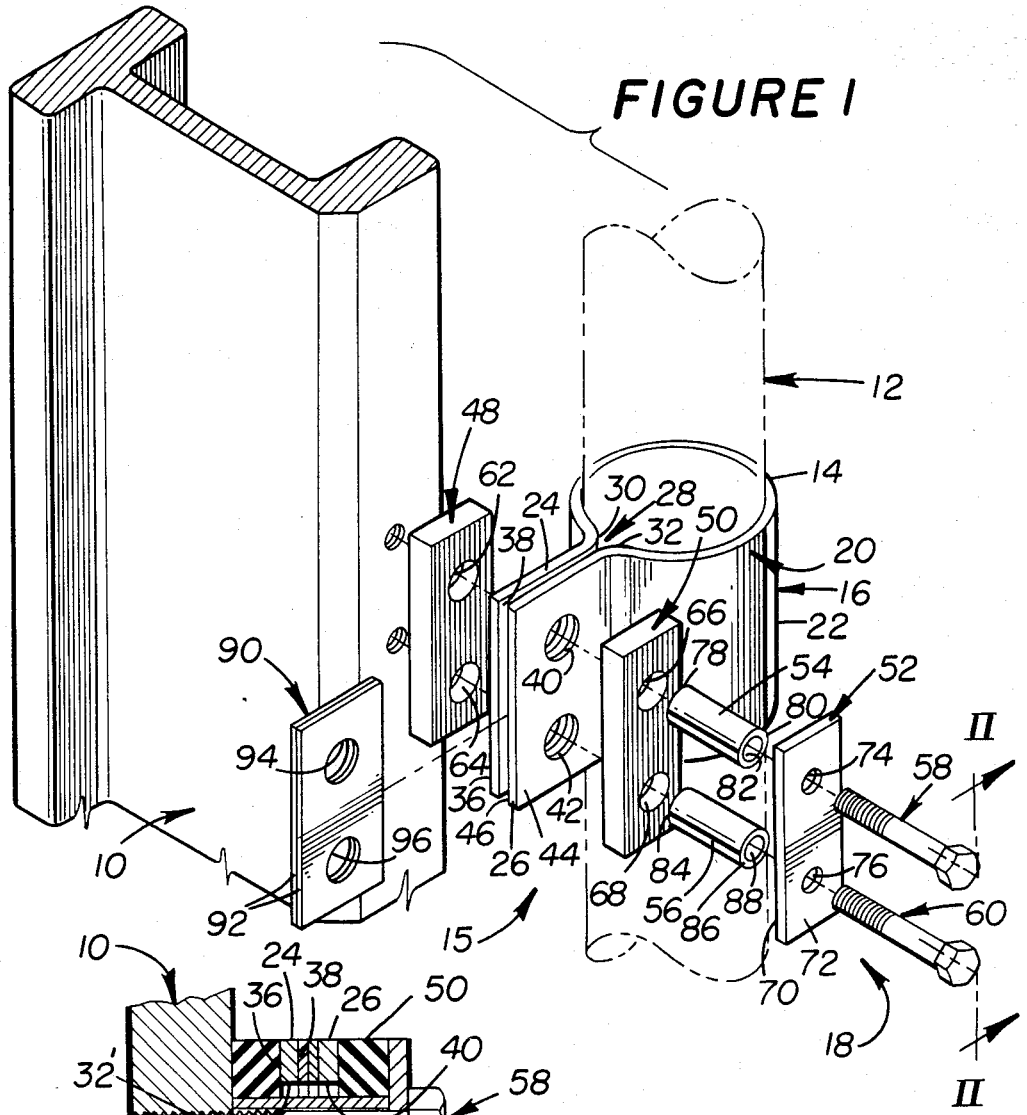
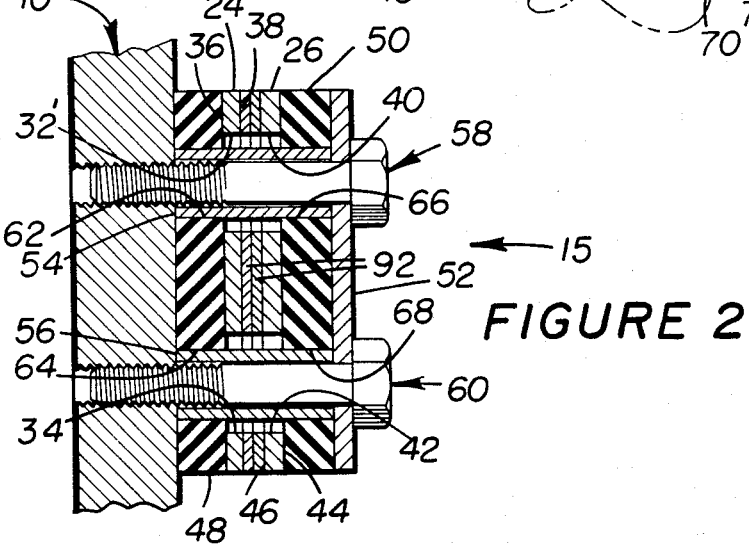
FIGURE 2

LIFT JACK RETENTION BRACKET

DESCRIPTION

1. Technical Field

The present invention relates generally to a lift mast, and, more particularly, to a lift jack retention bracket for allowing relative movement of a lift jack with respect to a stationary upright of the lift mast when the jack is in an extended load carrying position.

2. Background Art

A known lift mast for supporting a load bearing carriage includes a stationary upright, a movable upright supported by the stationary upright, and a lift jack having a cylinder from which a rod is axially extendable, the lift jack being adapted to act in certain circumstances, between the stationary upright and the movable upright. A sheave of a chain sheave assembly can be mounted to, generally, the rod of the lift jack and the chain can be attached at one end to the carriage and at the other end to a stationary structure such as the stationary upright. Such an assembly can then serve for lifting the carriage. In one particularly useful structure, after the carriage has been raised through a selected free lift distance, the chain sheave assembly engages a lateral cross member affixed to each movable upright. The free lift distance is provided for raising the carriage off a floor without extending the lift mast to allow operation of the lift truck in areas of low overhead clearance. After engagement of the chain sheave assembly with the lateral cross member, further extension of the rod raises the movable upright for providing support for and further elevation of the carriage.

A problem associated with the lift mast arises when the lift mast is being extended during a load carrying operation. The carriage, having a pair of forks horizontally extending forward of the lift mast for carrying the load, develops a moment or torque about the movable upright which is, in turn, displaced from a colinear alignment with the stationary upright. The loss of colinear alignment further displaces the rod of the lift jack from coaxial alignment with the cylinder. A bearing and a hydraulic seal, disposed between the rod and the cylinder, are subject to stress and undue wear when the rod is so displaced.

This problem was recognized by Ulinski (U.S. Pat. No. 3,289,791, issued Dec. 6, 1966) who provided a spherical hydraulic seal pivotably mounted in a rod end portion of the cylinder. A bore through the seal received the rod. Clearance was provided between the rod and cylinder. As the rod was displaced from coaxial alignment with the cylinder, the seal pivoted to minimize stress and wear thereon. Although the spherical hydraulic seal provided by Ulinski is not subject to undue stress and wear, it does require a specially designed rod end portion of the cylinder to accept such a seal. As discussed in the Ulinski patent, others developed special mountings for the cylinder which would permit lateral movement thereof. However, the special mountings have not been widely accepted as it is common practice in the art to fix the cylinder to the stationary upright by welding or other more convenient means.

The present invention is directed to overcoming one or more of the problems as set forth above.

DISCLOSURE OF THE INVENTION

In one aspect of the present invention, a lift jack retention bracket includes means for engaging a rod end portion of a cylinder of a lift jack and means for resiliently mounting the engaging means to a stationary upright of a lift mast for allowing the cylinder to move in response to a moment exerted on a movable upright of the lift mast upon extension of an extensible rod of the lift jack when extending the lift mast.

The resiliently mounting means bears the stress induced by the moment or torque applied to the rod of the lift jack by allowing the cylinder to move relative to the stationary upright and maintain coaxial alignment of the rod and cylinder. The lift jack need not have specially constructed hydraulic seals.

BRIEF DESCRIPTION OF THE DRAWINGS

FIG. 1 is an exploded view of an embodiment of a lift jack retention bracket according to the principles of the present invention;

FIG. 2 is an assembled cross sectional view taken along line 2—2 of FIG. 1;

BEST MODE OF CARRYING OUT THE INVENTION

Figure 4:
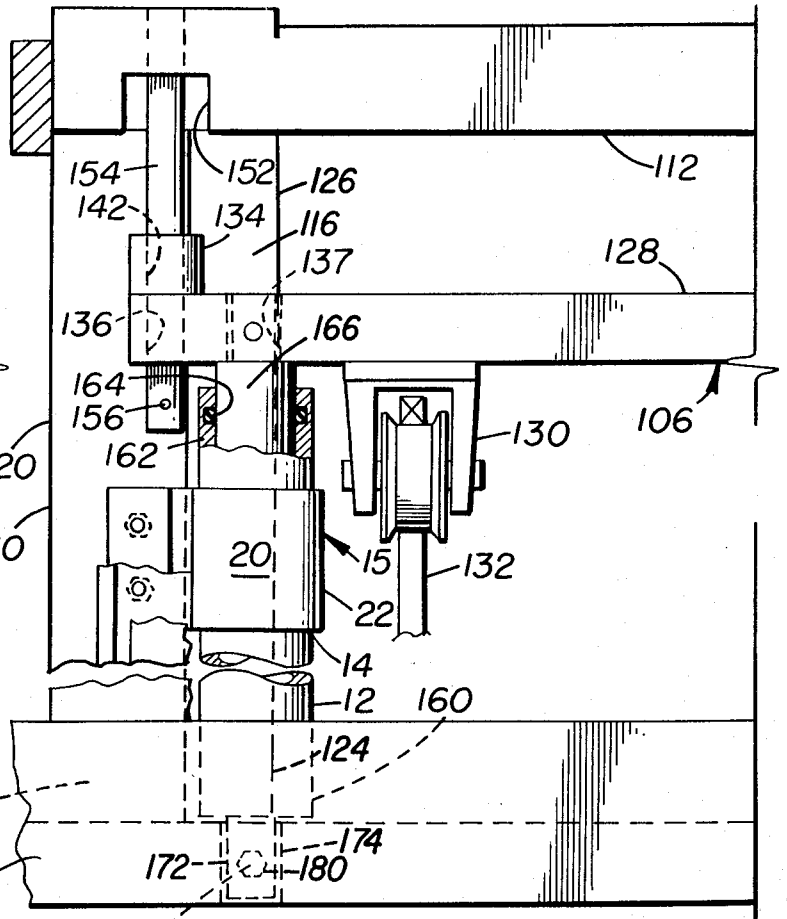
FIG. 4 is a rear elevational view, partially in cross section, partially broken away, of the mast assembly of FIG. 3.

Referring to FIGS. 1 and 2, there is shown a frame member 10, a hydraulic lift jack 12 having an axial portion 14 thereof, and a lift jack retention bracket 15 according to the principles of the present invention. As hereinafter described, frame member 10 preferably is a fixed mast upright wherein lift jack 12 is spaced from such upright and arranged generally parallel thereto.

Lift jack retention bracket 15 includes means 16 for engaging axial portion 14 and means 18 for resiliently mounting engaging means 16 to frame member 10 and, as hereinafter described, for allowing movement of lift jack 12 relative to frame member 10 at the connection of lift jack 12 to frame member 10.

Engaging means 16 includes a unitary bracket member 20 having a generally cylindrical portion 22, a first planar portion or flange 24, and a second planar portion or flange 26, each planar portion 24 and 26 extending radially outward from cylindrical portion 22 in overlying relationship. The planar portions or flanges are positioned in close proximity to frame member 10, hereinafter also termed a stationary upright 114.

Cylindrical portion 22 receiving and clamping a cylinder 158 of the jack therein, includes an axial slot 28 defining a first edge 30 and a second edge 32, first planar portion 24 being disposed along edge 30, second planar portion 26 being disposed along second edge 32. Axial portion 14 is received within cylindrical portion 22.

First planar portion 24 includes a first aperture 32', a second aperture 34, a first side 36 and a second side 38. Second planar portion 26 includes a first aperture 40, a second aperture 42, a first side 44 and a second side 46.

Second sides 38 and 46 are in a facing relationship to each other.

Mounting means 18 includes an oblong first elastomeric bushing 48, an oblong second elastomeric bushing 50, a generally rectangular plate 52, a first cylindrical spacer 54, a second cylindrical spacer 56, a first bolt 58 and a second bolt 60.

First bushing 48 has a first opening 62, a second opening 64, each opening 62 and 64 disposed therethrough. Second bushing 50 has a first opening 66 and a second opening 68, each opening 66 and 68 disposed therethrough. Plate 52 has a first face 70, a second face 72, a first hole 74 and a second hole 76. First spacer 54 has a first edge 78, a second edge 80 and an axial bore 82. Second spacer 56 has a first edge 84, a second edge 86 and an axial bore 88.

Mounting means 18 may further include shim means 90, such as one or more generally rectangular shims 92 having a first opening 94 and a second opening 96, for adjusting the diameter of cylindrical portion 22 to receive axial portion 14.

First bushing 48 is disposed intermediate frame member 10 and first side 36 of planar portion 24. Second bushing 50 is disposed intermediate first side 44 of planar portion 26 and first side 70 of plate 52. Shims 92 may be positioned between the facing second sides 38 and 46 of planar portions 24 and 26, respectively, for adjusting the diameter of cylindrical portion 22 to receive axial portion 14. First opening 62 of first bushing 48, first aperture 32' of planar portion 24, first opening 94 of shim 92, first aperture 40 of second planar portion 26 and first opening 66 of second bushing 50 are aligned and are each dimensioned to receive first spacer 54 in frictional engagement except for opening 96 and first apertures 32' and 40 which have a diameter substantially larger than first spacer 54. Second opening 64 of first bushing 48, second aperture 34 of planar portion 24, second opening 96 of shim 92, second aperture 42 of second planar portion 26 and second opening 68 of second bushing 50 are aligned and are each dimensioned to receive second spacer 56 in frictional engagement except for opening 96 and second apertures 34 and 42 which have a diameter substantially larger than second spacer 56.

First spacer 54 is positioned between frame member 10 and first face 70 of plate 52. First edge 78 abuts frame member 10 and second edge 80 abuts first face 70. Axial bore 82 and opening 74 are aligned with each other and are each dimensioned to receive bolt 58. Bolt 58 is threadedly engaged to frame member 10.

Second spacer 56 is positioned between frame member 10 and first face 70 of plate 52. First edge 84 abuts frame member 10 and second edge 86 abuts first face 70. Axial bore 88 and opening 76 are aligned with each other and are each dimensioned to receive bolt 60. Bolt 60 is threadedly engaged to frame member 10. Bolts 58 and 60 secure plate 52 and first and second spacers 54 and 56 to frame member 10, first and second bushings 48 and 50 being compressed.

Figure 3:
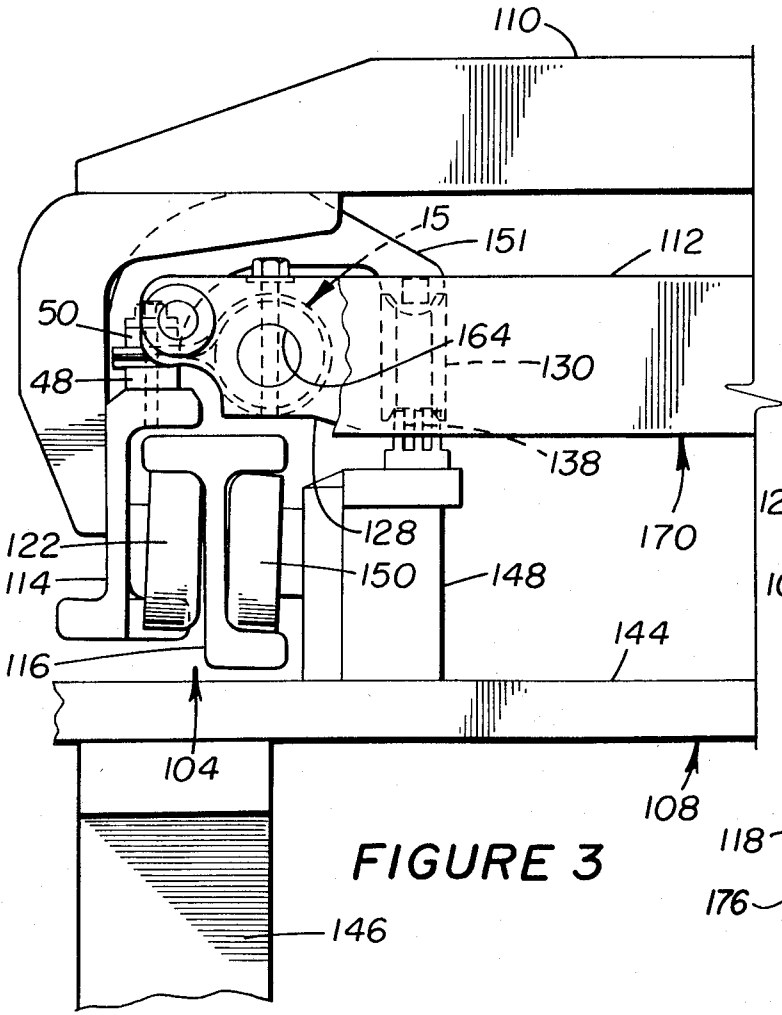
FIG. 3 is a partial top plan view of a lift mast, broken away.
Figure 5:
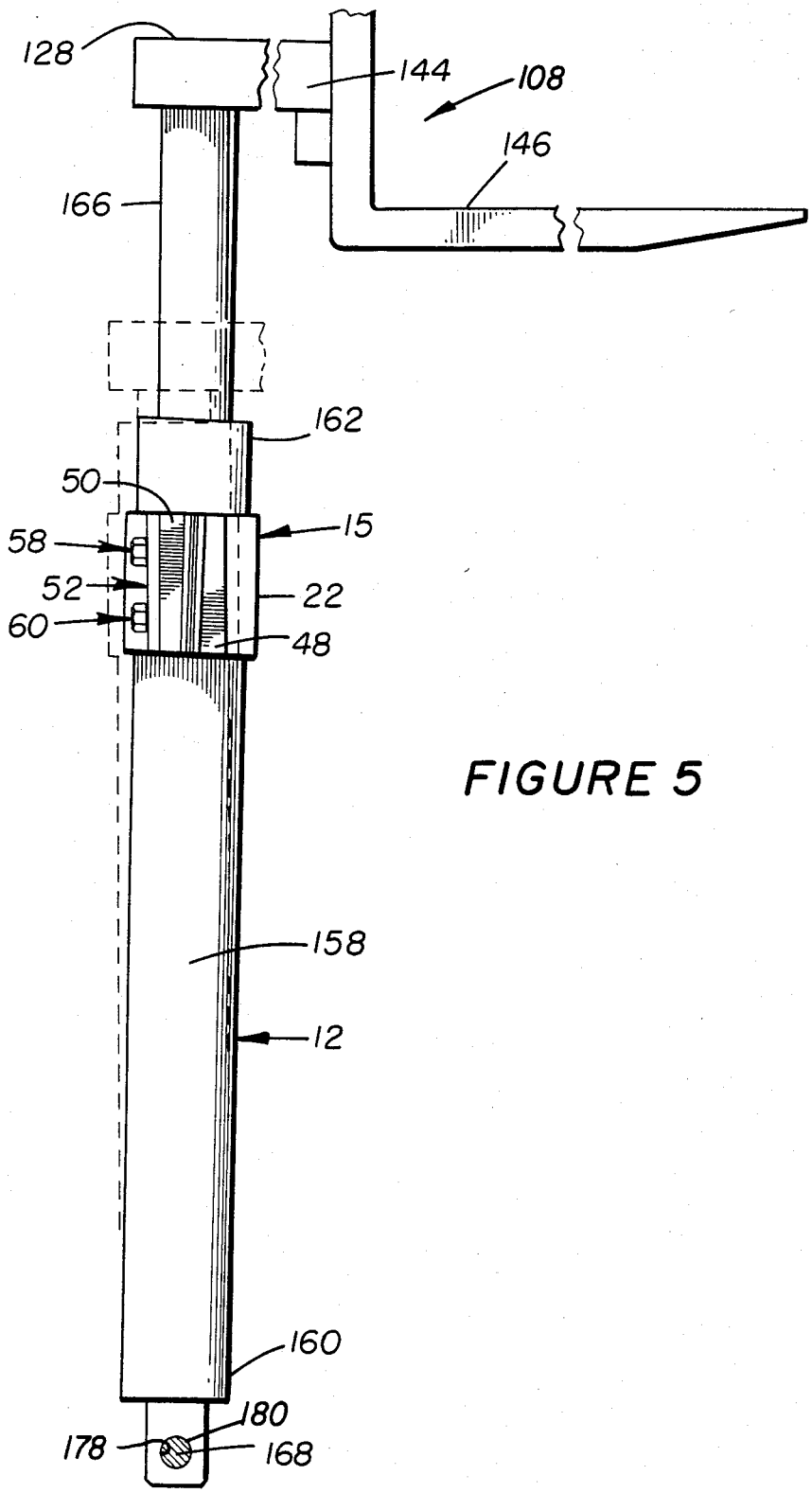
FIG. 5 is a side elevational view, partially broken away, showing the embodiment of the lift jack retention bracket of FIG. 1 and a lift jack of the lift mast of FIGS. 3 and 4 in an elevated position.

Referring now to FIGS. 3, 4 and 5, there is shown a lift mast 104 of frame member 10, a chain sheave assembly 106, a carriage assembly 108 movably mounted on lift mast 104, a lateral tie bar 110 for bracing lift mast 104, and a lateral cross member 112 engageable with chain sheave assembly 106. It should be noted that FIGS. 3 and 4 show only one-half of a mast assembly, the broken away elements not shown being identical in mirror image.

Lift mast 104 is particularly adapted for use on an otherwise standard lift truck 100 (FIG. 6) and includes a stationary upright 114 and a movable upright 116. Stationary upright 114 has a first end portion 118, a second end portion 120 and a roller 122. Movable upright 116 has a first end portion 124 and a second end portion 126, and is movably supported by roller 122 within stationary upright 114. Tie bar 110 is fixed, such as by welding, to second end portion 120 of stationary upright 114. Cross member 112 is fixed to second end portion 126 of each movable upright 116. In a lowered position, first end portions 118 and 124 of stationary upright 114 and movable upright 116, respectively, are spaced adjacent each other. In a raised position, first end portion 124 of movable upright 116 is spaced adjacent second end portion 120 of stationary upright 114.

Chain sheave assembly 106 includes a generally elongated member 128, a pulley assembly 130 mounted to an underside of elongated member 128, a chain 132, and a cylindrical bushing 134. Elongated member 128 has a first hole 136 and a second hole 137.

Chain 132 has a first end 138 and a second end 140, chain 132 being carried by pulley assembly 130. Cylindrical pin 134, having an axial bore 142, extends upwardly from an end of elongated member 128. First hole 136 is in communication with axial bore 142. Second hole 137 is spaced parallel from first hole 136.

Carriage assembly 108 (FIG. 3, 5 and 6) includes a generally rectangular back rest 144, a fork 146 extending forwardly from back rest 144 for carrying a pallet or load, a mounting member 148 extending rearwardly from back rest 144, and a roller 150. Carriage assembly 108 is movably supported by roller 150 within movable upright 116. First end portion 138 of each chain 132 is secured, in a conventional manner, to mounting member 148. Second end 140 of each chain 132 is secured to stationary upright 114. Stationary upright 114, may have a generally arcuate member 151 to which second end 140 of chain 132 is secured.

Cross member 112 (FIG. 4) includes a cylindrical recess 152 and a pulldown rod 154, pulldown rod 154 coaxially extending downwardly from recess 152. Recess 152 is dimensioned to receive cylindrical bushing 134. Pulldown rod 154 is dimensioned to be received in linear slidable engagement within first hole 136 and axial bore 142. Pulldown rod 154 has an axial projection 156 disposed at a lower end thereof.

Lift jack 12 (FIGS. 4 and 5) includes a cylinder 158 having a head end portion 160 and a rod end portion 162, a rod seal 164 disposed within rod end portion 162, and an extensible rod 166 in sealingly slidable engagement with seal 164 and coaxially extendable from cylinder 158. Means 168 for pivotally connecting head end portion 160 adjacent first end portion 118 of stationary upright 114 is provided. A free end of extensible rod 166 is received within second hole 137 of elongated member 128 and secured thereto. Lift jack 12 is disposed between lift mast 104 and arcuate member 151. Rod end portion 162 is attached to second end portion 120 of stationary upright 114 by retention bracket 15 as hereinabove described with respect to frame member 10, frame member 10 being defined by second end portion 120, and axial portion 14 being defined by rod end portion 162. Chain sheave assembly 106 and cross member 112 define means 170 for connecting extensible rod 166 to second end portion 126 of movable upright 116.

Pivotal connecting means 168 (FIGS. 4 and 5) includes a shaft 172 extending axially outwardly from head end portion 160 and being of a reduced diameter therefrom, and a bore 174 dimensioned to receive loosely shaft 172 and to permit pivotal movement of shaft 172 therein. A lower crossmember 176 extends outwardly from first end portion 118 of stationary upright 114 and may include bore 174. Although not necessary in practicing the present invention, pivotal connecting means 168 may further include a radial opening 178 disposed through shaft 172 and a bolt 180 loosely received through radial opening 178 and being threadedly engaged to lower crossmember 176.

Industrial Applicability

Figure 6:
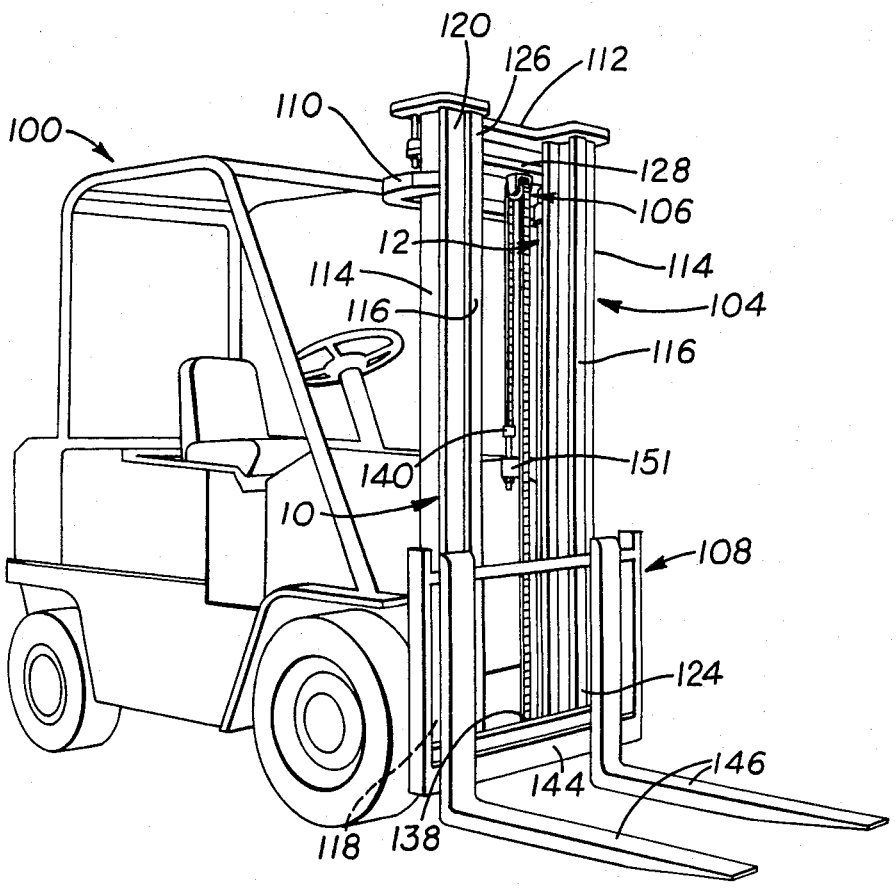
FIG. 6 is a front-side isometric view of a lift truck embodying this invention.

The present invention is particularly useful, although not intended as a limitation thereon, in a lift mast of the type commonly affixed to a vehicle such as lift truck 100 of FIG. 6.

As extensible rod 166 is raised from a fully lowered position, thereby raising sheave assembly 106, and carriage assembly 108 is raised within movable upright 116. After sheave assembly 106, and more particularly elongated member 128 and cylindrical bushings 134 thereof engage cross member 112 (FIG. 4), movable upright 116 is raised therewith. Movable upright 116 is lowered when, upon lowering sheave assembly 106, projection 156 of pulldown rod 154 is engaged by the lower surface of elongated member 128. The distance that carriage assembly 108 is raised from a fully lowered position until elongated member 128 engages cross member 112 is defined as a free lift distance. Above the free lift distance carriage assembly 108 moves from the first end portion 124 to the second end portion 126 of movable upright 116 at twice the rate of the elevation of movable upright 116 within stationary upright 114.

As best shown in FIG. 5, when extensible rods 166 are extended, thereby raising carriage assembly 108 as hereinabove described toward second end portion 126 of movable upright 116, a load carried on forks 146 will exert a moment, maximized at full elevation, upon movable upright 116 at second end portion 126 thereof. This moment will displace movable upright 116 from parallel alignment with stationary upright 114. This moment is further transferred to extensible rod 166 by connecting means 170. Maintaining coaxial alignment of extensible rod 166 to cylinder 158 is necessary to prevent undue wear and stress on seal 164.

The moment acting on extensible rod 166 may be considered as the net of two linear components of force, one component acting axially along rod 166 (thus lift jack 12) and the other component acting radially to rod 166. The axial component is absorbed primarily by pivotally connecting means 168. The radial component is absorbed primarily by bushings 48 and 50 as lift jack 12 pivots about connecting means 168. As a result, undue wear of rod seal 164 and rod 166 is minimized.

Other aspects, objects and advantages of this invention can be obtained from a study of the drawings, the disclosure, and the appended claims.

We claim:

1. A lift mast (104) adapted for mounting on a lift truck (100) comprising a statutory upright (114), a movable upright (116), movably mounted on said stationary upright (114), at least one lift jack (12) interconnected between said stationary upright (114) and said movable upright (116), said lift jack (12) having a cylinder (158) and an extensible rod (166) reciprocally mounted in said cylinder (158), and means (16,18) for resiliently mounting said cylinder (158) on said stationary upright (114) to allow said cylinder (158) to move slightly relative to said stationary upright (114) in response to the imposition of a moment on an upper end of said movable upright (116), said means (16,18) including a unitary bracket member (20) attached between said cylinder (152) and said stationary upright (114), said bracket member (20) including a cylindrical portion (22) clamped about the upper end of said cylinder (158) and a pair of overlying flanges (14,26) extending radially outwardly from said cylindrical portion (22) and positioned in close proximity to said stationary upright (114), at least one elastomeric bushing (48) disposed and compressed between said flanges (24,26) and said stationary upright (114) and bolt means (58,60) extending through said flanges (24,126) and said bushing (48) for releasably attaching them to said stationary upright (114).

2. The lift mast (104) of claim 1 wherein said means (16,18) further includes a second elastomeric bushing (50) disposed on an outer side of said flanges (24,26) and a clamping plate (52) disposed on an outer side of said second elastomeric bushing (50), said bolt means (58, 60) extending sequentially through said plate (52), said second elastomeric bushing (50), said flanges (24,26) and said first elastomeric bushing (48).

3. The lift mast (104) of claim 2 wherein said means (16,18) further includes spacer means (54,56) extending through said flanges (24,26) and each of said first and second elastomeric bushings (48,50) for precisely positioning said plate (52) relative to said stationary upright (114) upon tightening of said bolt means (58,60).

4. A lift mast (104) adapted for mounting on a lift truck (100) comprising a stationary upright (114), a movable upright (116), movably mounted on said stationary upright (114), at least one lift jack (12) interconnected between said stationary upright (114) and said movable upright (116), said lift jack (12) having a cylinder (158) and an extensible rod (166) reciprocally mounted in said cylinder (158), and means (16,18) for resiliently mounting said cylinder (158) on said stationary upright (114) to allow said cylinder (158) to move slightly relative to said stationary upright (114) in response to the imposition of a moment on an upper end of said movable upright (116), said means (16,18) including a bracket member (20) attached between said cylinder (152) and said stationary upright (114), said bracket member (20) including a cylindrical portion (22) clamped about the upper end of said cylinder (158) and a pair of overlying flanges (24,26) extending radially outwardly from said cylindrical portion (22) and secured to said stationary upright (114), a first elastomeric bushing (48) disposed between said flanges (24,26) and said stationary upright (114), a second elastomeric burshing (50) disposed on an outerside of said flanges (24,26), a clamping plate (52) disposed on an outer side of said second elastomeric bushing (50), and bolt means (58,60) extending sequentially through said plate (52), said second elastomeric bushing (50), said flanges (24,26) and said first elastomeric bushing (48) for releasably attaching them to said stationary upright (114).

* * * * *